United States Patent [19]

Yasui

[11] Patent Number: 4,890,633

[45] Date of Patent: Jan. 2, 1990

[54] TREATING APPARATUS EQUIPPED WITH A SWING MECHANISM

[75] Inventor: Fumio Yasui, Omiya, Japan

[73] Assignee: Nippon Paint Co., Ltd., Osaka, Japan

[21] Appl. No.: 284,060

[22] Filed: Dec. 12, 1988

[30] Foreign Application Priority Data

Dec. 26, 1987 [JP] Japan ..... 62-328406

[51] Int. Cl.[4] ..... B08B 3/04

[52] U.S. Cl. ..... 134/76; 134/82

[58] Field of Search ..... 134/76, 82, 83, 70, 134/72, 73, 74, 135

[56] References Cited

U.S. PATENT DOCUMENTS

| | | | |
|---|---|---|---|
| 2,741,252 | 4/1956 | Davis | 134/83 X |
| 2,811,262 | 10/1957 | Schaitberger | 134/76 X |
| 3,098,494 | 7/1963 | Drexinger et al. | 134/83 X |
| 4,392,506 | 7/1983 | Tanaka et al. | 134/83 X |
| 4,421,130 | 12/1983 | Kataishi et al. | 134/83 X |
| 4,688,668 | 8/1987 | Ookubo et al. | 198/621 |

FOREIGN PATENT DOCUMENTS

| | | | |
|---|---|---|---|
| 1107479 | 5/1961 | Fed. Rep. of Germany | 134/76 |
| 57-200600 | 12/1982 | Japan . | |
| 58-110699 | 7/1983 | Japan . | |

*Primary Examiner*—Philip R. Coe

*Attorney, Agent, or Firm*—Wenderoth, Lind & Ponack

[57] ABSTRACT

An apparatus for treating a workpiece by a pre-treatment process before painting or for a washing process in an electrodeposition treatment. The workpiece is transferred through a series of treating zones. The apparatus has a plurality of hanger disposed on the right and left sides relative to the advanceing direction of the workpiece, a pair of hanger travelling rails, a hanger carrying mechanism and a plurality of hanger lifting assemblies disposed on the right and left sides of the advancing direction. Each rail consists of fixed rail portions and movable rail portions. Right and left lifting assemblies are controlled in cooperation, simultaneously or alternately, to move the hangers up and down allowing the workpiece to tilt or oscillate within the treating zone.

3 Claims, 4 Drawing Sheets

TREATING APPARATUS EQUIPPED WITH A SWING MECHANISM

BACKGROUND OF THE INVENTION

This invention relates to a treating apparatus utilized for pre-treatment process in which workpieces such as car bodies, household electrical goods or steel furniture are treated with degreasing, water washing and chemical conversion coating, or utilized for washing process in electrodeposition treatment.

In general, metallic workpieces to be treated are processed through a series of treating stages comprising degreasing, water washing, chemical conversion coating, water washing and painting. The term "pre-treatment" used herein means a treatment process before the painting stage.

In conventional treating apparatus, workpieces to be treated are transferred through several stages in succession by a conveyor. For example, a pre-treatment for painting a car body is carried out through the aforementioned stages, in which the car body is sprayed with chemical liquid or immersed into a dipping bath. Since workpieces are generally formed in complicated shapes, cavities behind the workpiece or inside surfaces thereof are apt to remain untreated due to blind spaces or floating bubbles, resulting in poor painting.

To eliminate the above difficulties in the way of performing high quality painting, many attempts have been made. In a most popular design, a travelling workpiece is supported by a pair of hoists through vertically extending wires. When the workpiece is immersed into a dipping bath, the hoists actuate in cooperation, simultaneously or alternately, to move the workpiece piece downward allowing it to swing or oscillate for expelling air bubbles from inside thereof. Since the workpiece is suspended through longitudinal wires, it is apt to oscillate in lateral directions while it is immersed into the bath. To prevent the workpiece from colliding against the wall of the tank, the vertically extending wires should be operated slowly. As a result, it is impossible to accellate the treating speed of the workpiece.

In another prior design, a tilting cylinder is mounted near a bottom end of a vertical elevator post such that a lifting rest for a workpiece can be oscillated in lateral directions. In this design, however, the workpiece is oscillated relatively distant from the central position, so that the dipping bath needs a larger width as well as a greater quantity of treating liquid.

SUMMARY OF THE INVENTION

It is an object of the present invention to provide a treating apparatus equipped with a swing mechanism which can oscillate a workpiece a full amount within a tank for performing high quality painting.

Another object of the present invention is to provide a treating apparatus which can shorten the processing time for traversing a plurality of treating zones as well as the oscillating time for the workpiece.

Still another object of the present invention is to provide a treating apparatus in which the treating zones are as small as possible for making the overall size of the apparatus with a carrying mechanism and the swing mechanism as short as possible.

The foregoing and other objects of the present invention are accomplished by a treating apparatus for transferring a workpiece to be treated through a series of treating zones while it is carried along a conveyor such that the workpiece is immersed into dipping baths or sprayed with treating liquid within the zones comprising: a plurality of hangers disposed along right and left sides relative to the advancing direction of the workpiece for hanging the workpiece thereon, a pair of hanger travelling rails extending parallel to said advancing direction, each rail supporting the upper ends of a half of said hangers, a hanger carrying mechanism for advancing said hangers along said rails, a plurality of hanger lifting assemblies disposed along right and left sides of the advancing direction, each assembly being located adjacent a corresponding treating zone; characterized in that each of said hanger travelling rails consists of fixed rail portions and movable rail portions located adjacent a corresponding treating zone, and said hanger lifting assemblies are controlled such that when a pair of right and left hangers are on movable rail portions, corresponding right and left hanger lifting assemblies actuate in cooperation, simultaneously or alternately, to move the hangers up and down allowing the workpiece to tilt or oscillate within the corresponding treating zone.

In the apparatus according to the invention, the workpiece suspended from a pair of hangers initially moves forward along fixed rail portions disposed along the right and left of the advancing direction. When it reaches an upper space above a treating zone it moves from the fixed rail portions onto the movable rail portions, and then a pair of hanger lifting assemblies actuate to move the workpiece downward to a predetermined horizontal level. If the right and left hanger lifting assemblies actuate in synchronized fashion, the workpiece moves downward while maintaining a the horizontal posture. If there is a difference between the lowering heights of the right and left hangers, the workpiece is caused to tilt or oscillate toward the right or left direction. Thus, the workpiece can be tilted or oscillated until air bubbles remaining behind the workpiece are expelled completely. Accordingly, the immersing treatment and spraying treatment of the workpiece are efficiently performed, so that poor painting is considerably reduced.

The hangers for suspending the workpiece can be made of a slender rod or a chain having a fixed overall length. Accordingly, there is no excessive oscillation caused by the movement of the workpiece, thereby allowing accelerated moving speed to effect for completing the treatment process.

With respect to the length of the hanger, since a relatively short length is sufficient to support the workpiece thereon, there is little oscillation even if the workpiece moves in lateral directions. Therefore, extra spaces in the treating zones can be omitted and the overall arrangement can be designed in a relatively compact style.

In a preferable embodiment of the invention, each of the hanger lifting assemblies includes a lifting arm supporting the movable rail portion, a vertical post for guiding the lifting arm, and driving means for moving the lifting arm up and down along the vertical post.

In another preferable embodiment of the invention, each of the rails is formed in a loop such that each hanger returns to an initial position entrained by a hanger replacing conveyor after having completed an advancing path entrained by the carrying mechanism.

Other objects, features and advantages of the invention will become apparent from a reading of the specification, in conjunction with the drawings, in which, like reference numerals refer to like elements in the several views.

DESCRIPTION OF THE PREFERRED EMBODIMENT

In FIGS. 1 to 7, an embodiment of the treating apparatus according to the invention is illustrated which is equipped with a swing mechanism.

Figure 7:
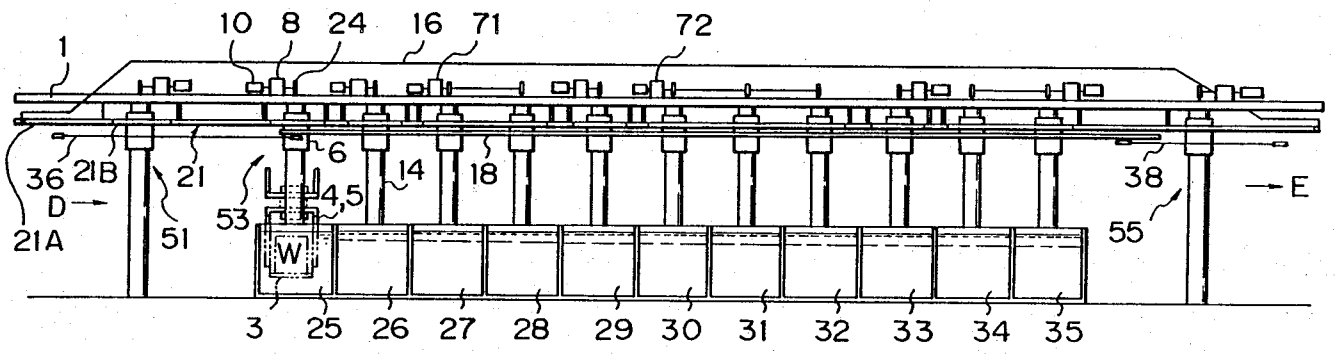
FIG. 7 is a vertical section taken along the advancing direction of the workpiece illustrating the overall tanks.

Referring to FIG. 7, there is shown a series of treating zones, which comprise, along the advancing direction of a workpiece W, a preliminary degreasing tank 25, a degreasing tank 26, a first water washing tank 27, a surface treatment tank 28, a chemical conversion coating tank 29, a second water washing tank 30, a third water washing tank 31, a purified water washing tank 32, an electrodeposition tank 33, a fourth water washing tank 34, and a fifth water washing tank 35. In all there is a total of eleven tanks arranged in series.

Figure 6:
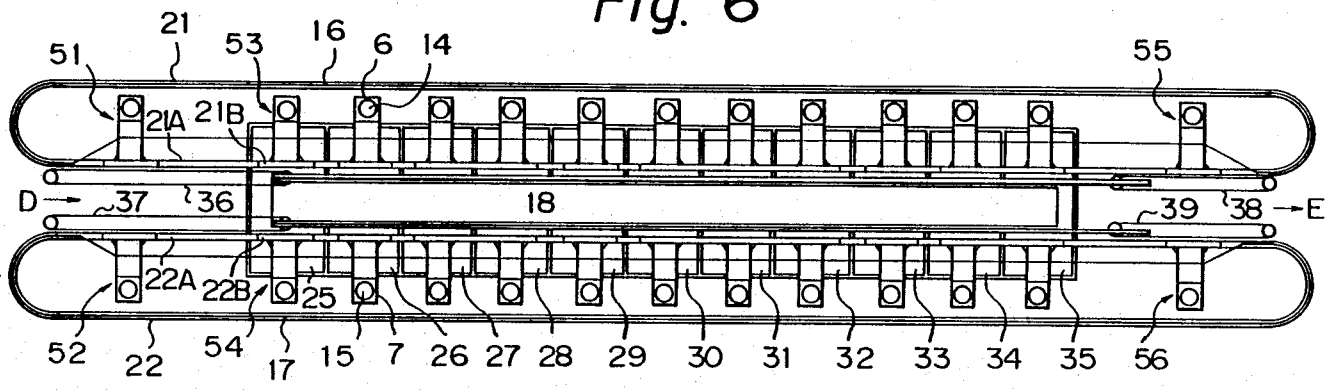
FIG. 6 is a plan view illustrating the overall outline of the embodiment.

In FIGS. 6 and 7, a workpiece W to be treated such as a car frame is suspended from a workpiece support 3 and rigid pole hangers 4 and 5 at an entrance position D. The workpiece W is lifted by a first pair of lifting assemblies 51 and 52 and then transferred toward dipping tanks, being carried by a pair of workpiece supplying conveyors 36 and 37. The workpiece W stops nearly at a central position above each dipping tank and gets lowered into the tank by a pair of lifting assemblies 53 and 54 to be given an immersing treatment or spraying treatment. During the treatment, the workpiece is moved to swing it for the purpose of expelling air bubbles remaining inside thereof.

After completion of the treatment, the workpiece gets lifted by the lifting assemblies and then carried to the next dipping tank. When the treatment within the final tank is finished, the workpiece W gets suspended and transferred toward an exit position E, being carried by a pair of workpiece releasing conveyors 38 and 39. At the exit position E, the workpiece W gets lowered by a pair of lifting assemblies 55 and 56, and the hangers 4 and 5 are disconnected from the workpiece support 3, being returned to the initial position D by a pair of hanger return conveyors 16 and 17.

The hangers 4 and 5 are moved, between the entrance D and the exit E, along hanger travelling rails 21 and 22, respectively, being advanced intermittently by a hanger carrying mechanism 60 as described hereinafter. The hanger travelling rails 21 and 22 comprise fixed rail portions 21A and 22A and movable rail portions 21B and 22B disposed adjacent corresponding tanks, respectively. The fixed rail portions and the movable rail portions are conveniently disposed side by side to form a pair of loops as shown in FIG. 6. When the hangers 4 and 5 are on the movable rail portions they are moved up and down together with the movable rail portions by the aforementioned lifting assemblies.

The workpieces W are supplied to the dipping tanks in succession synchronized with a pitch length between the dipping tanks. At the completion of treatment within each dipping tank the workpiece is transferred forward by the pitch length.

Figure 1:
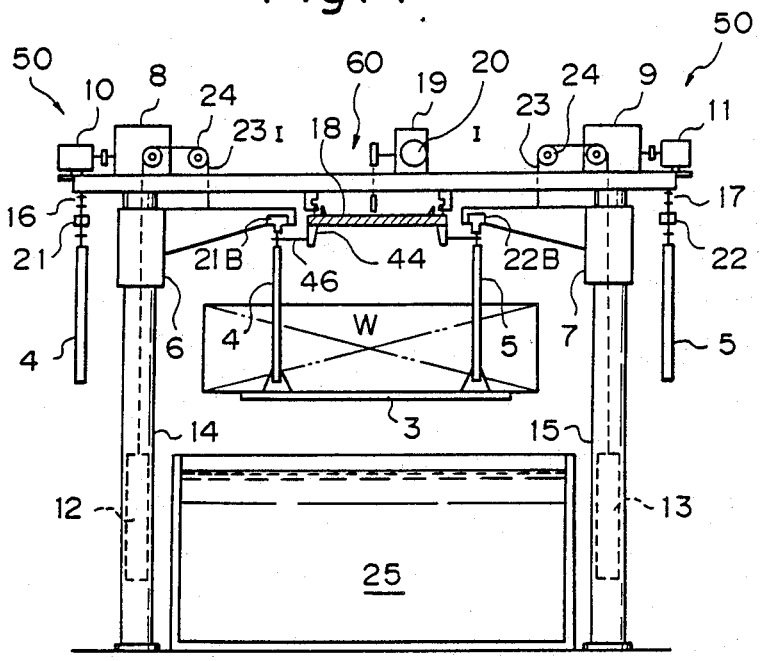
FIG. 1 is a vertical section of an embodiment of the apparatus according to the invention.

FIG. 1 illustrates a swing mechanism of the principal part of the invention in a vertical section from the entrance D. In this figure, the workpiece W is at a nearly central position above the first dipping tank 25. The upper ends of the hangers 4 and 5 are on the movable rail portions 21B and 22B (see FIG. 5), respectively, and these movable rail portions are supported by right and left lifting arms 6 and 7, respectively.

The lifting arms 6 and 7 are guided such that they can slide up and down along vertical posts 14 and 15 extending from a top plate 1 to a floor surface, being connected to driving means and a power supply mechanisms such as motors 10 and 11, and power transmitting mechanisms such as gear boxes 8 and 9, and chains 23 and sprockets 24. To the bottom ends of the chains 23 are attached balancing weights 12 and 13 which can keep tension in the chains and also can reduce the power needed from the motors.

For carrying the hangers 4 and 5 to the operating positions from the positions as shown in FIG. 1, the right and left motors 10 and 11 are energized to move the chains 23 causing the lifting arms 6 and 7 to move downward. Then, the workpiece W moves downward to be immersed into the dipping tank 25.

Figure 2:
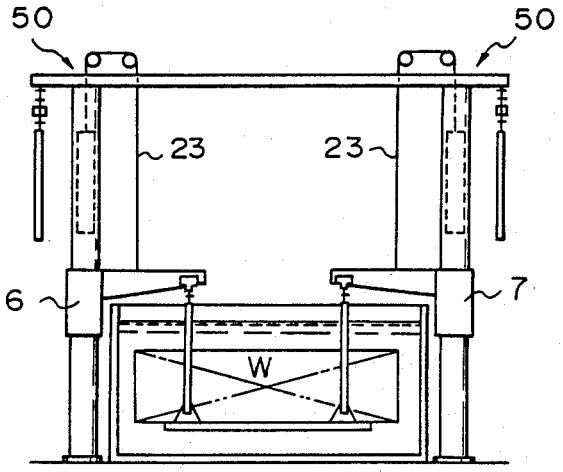
FIG. 2 is a vertical section illustrating a workpiece horizontally immersed into a dipping tank.

FIG. 2 shows a horizontally immersed condition of the workpiece W in which the right and left lifting arms 6 and 7 are lowered the same distance keeping the workpiece in a horizontal posture.

Figure 3:
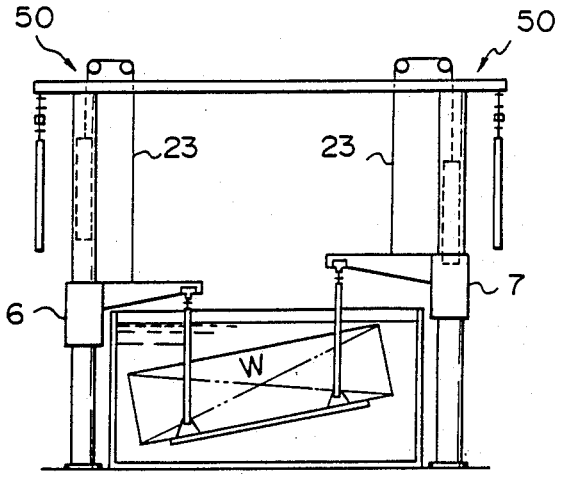
FIG. 3 is a vertical section illustrating the workpiece oscillated in one way within the tank.
Figure 4:
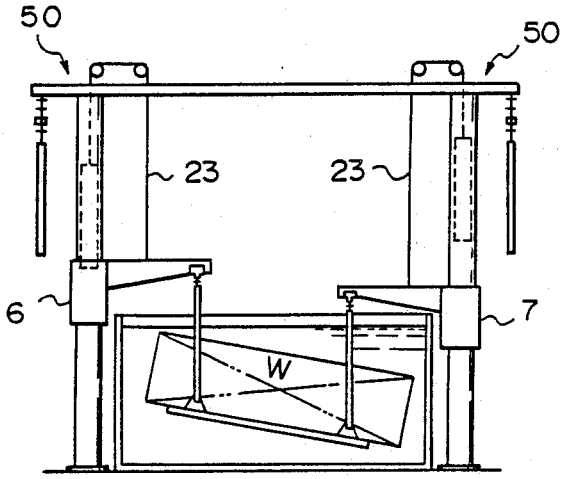
FIG. 4 is a vertical section illustrating the workpiece oscillated conversely within the tank.

FIGS. 3 and 4 show opposite swinging conditions of the workpiece W due to a difference between the lowering heights of the arms 6 and 7. The workpiece W is caused to tilt toward a right and then a left direction for the purpose of expelling air bubbles remaining behind the workpiece and spreading treating liquid to every corner thereof. The tilting angle, number of oscillations and speed thereof can be chosen to obtain optimum results depending upon the shape of the workpiece.

Figure 5:
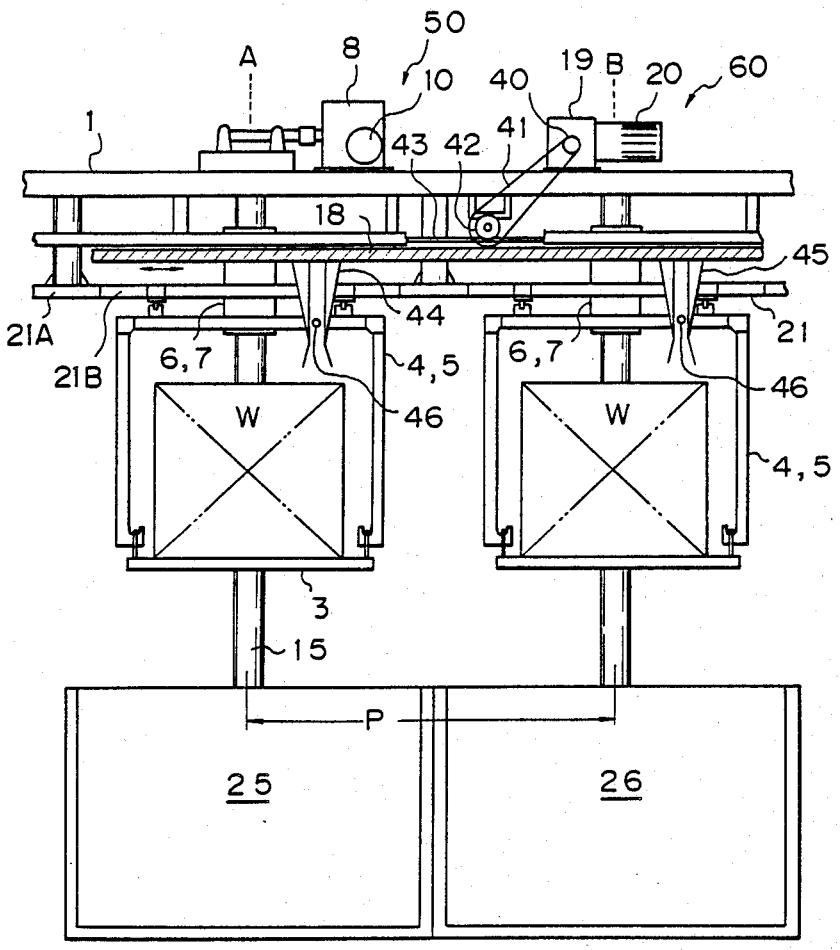
FIG. 5 is a vertical section taken along the advancing direction of the workpiece illustrating only two tanks.

FIG. 5 shows the details of the hanger carrying mechanism 60 which advances the hangers intermittently by a pitch length P from a central position A of the dipping tank 25 to a next central position B of the next dipping tank 26. The carrying mechanism 60 comprises a motor 20 and a gear box 19 both mounted on the top plate 1, a sprocket 40, a chain 41, a pinion 42, a rack 43, a forward and reverse reciprocating table 18 supporting the rack 43, and dog members 44 and 45 secured to the bottom side of the table 18. On the other hand, to the upper ends of the hangers 4 and 5 are attached horizontally extending guide bars 46 (see FIG. 1), which can engage with vertical slots of the dog members 44 and 45.

The hanger carrying mechanism 60 functions as follows: In the condition as shown in FIG. 5, the left-hand workpiece W is lifted to a top position after completion of the treatment in the tank 25 and is going to be carried to the next tank 26. At this moment the motor 20 is energized to drive the rack pinion mechanism, advancing the table 18 by a pitch length P. Simultaneously, the dog member 44 pushes the guide bar 46 attached to the hangers 4 and 5 forward, advancing the workpiece W nearly to a central position above the dipping tank 26. Then, the lifting assembly 50 starts in motion to lower the lifting arms 6 and 7 causing the hangers 4 and 5 to move downward, whereby the workpiece W gets immersed into the bath to the tank 26. As the hangers 4 and 5 move downward, the guide bar 46 escapes from the vertical slot within the dog member 44. Immediately after the completion of the escapement, the motor 20 rotates in the reverse direction causing the table 18 to move backward by a pitch length P. When the treatment in the tank 26 is completed and the hangers 4 and 5 move upward, the guide bar 46 engages in turn with the slot of the next dog member 45. Thus, the workpiece W is intermittently advanced by a pitch length P to be treated within each of the tanks, while the motor 20 repeats forward and reverse revolutions in association with the lifting arms moving upward and downward.

As shown in FIG. 7, the motor for driving the lifting assemblies can be changed to a motor 71 which drives simultaneously two sets of lifting arms for two successive tanks, or a motor 72 which drives simultaneously three sets of lifting arms for successive tanks, for three the purpose of reducing the cost.

The treating apparatus of the invention is preferably provided with many kinds of sensors and controls so as to perform highly efficient automatic processings.

Thus, as is apparent from the above description, the treating apparatus of the invention can provide technical advantages as follows:

(1) Since the workpiece can be fully tilted and oscillated within the treating zones, air bubbles are efficiently expelled and poor painting is considerably reduced.

(2) Since the tilting angle, numbers of swinging or speed of swinging can be selected to be optimum depending upon the shape of the workpiece, any complicatedly formed workpiece can be oscillated in the most efficient style so as to expel the air bubbles and to apply the treatment liquid to every corner.

(3) Since the workpiece is suspended from hangers of relatively short length, there is no excessive oscillation even if the workpiece moves in lateral directions, whereby extra spaces are unnecessary. Further, such oscillation is carried out a short time, the treating time within the zones being considerably shortened.

(4) Since the workpiece is carried intermittently by the reciprocating table, the lateral dimensions of the apparatus can be made relatively small, so that the overall size of the apparatus is also made relatively short.

I claim:

1. An apparatus for transferring a workpiece to be treated along a path through a series of successive treating zones with the workpiece being immersed in dipping baths or sprayed with treating liquid within the respective zones, said apparatus comprising:

a plurality of rod hangers disposed in pairs along the path with one hanger of each pair on one side of the path and the other hanger of each pair on the other side of the path for supporting a workpiece on each pair;

a pair of hanger traveling rails extending parallel with said path, one rail movable supporting the upper end of a corresponding hanger of each of said pairs of hangers and the other rail movable supporting the upper end of the other hanger of each of said pairs of hangers;

a hanger advancing means for advancing said hangers along said rails; and a plurality of pairs of hanger raising and lowering assemblies, at least one adjacent each of said treating zones, with one hanger raising and lowering assembly of each pair on one side of said path and the other hanger raising and lowering assembly on the other side of said path;

each of said hanger traveling rails having movable rail portions located at each corresponding treating zone and fixed rail portions extending between said treating zones, said hanger raising and lowering assemblies being connected to said movable rail portions and operable for, when a pair of right and left hangers is moved onto movable rail portions corresponding to the right and left hanger raising and lowering assemblies, simultaneously or alternately moving said movable rail portions for moving said hangers up and down for causing a workpiec being carried by the hangers to move downwardly into the treating zone and to tilt or oscillate within the treating zone and to move upwardly out of the treating zone, the distance said movable rail portions are movable in the downward direction from the fixed rail portions being less than the vertical distance from said fixed rail portions to the top of the treating zone, whereby said movable rail portions are kept out of the treating zones.

2. An apparatus as claimed in claim 1 wherein each of said rails is in a loop, a part of which extends long said path, and a hanger return conveyor extending along the remainder of said rails for moving hangers from the end of the part of said rails along said path to the beginning of said part.

3. An apparatus as claimed in claim 1 in which said hanger advancing means comprises a reciprocating table positioned between said hanger traveling rails and including means for engaging a pair of hangers at a preceding treatment zone and during movement in a forward direction advancing said pair of hangers to the next succeeding treatment zone.

* * * * *